US006623373B2

(12) United States Patent
Carlton et al.

(10) Patent No.: US 6,623,373 B2
(45) Date of Patent: Sep. 23, 2003

(54) GOLF PRACTICE PLATFORM

(76) Inventors: Peter Carlton, 2295 Mark Rd., Yorktown Heights, NY (US) 10598; Randy Carlton, 2295 Mark Rd., Yorktown Heights, NY (US) 10598

( * ) Notice: Subject to any disclaimer, the term of this patent is extended or adjusted under 35 U.S.C. 154(b) by 0 days.

(21) Appl. No.: 10/013,219

(22) Filed: Dec. 6, 2001

(65) Prior Publication Data

US 2003/0109325 A1 Jun. 12, 2003

(51) Int. Cl.[7] ..... A63B 69/36
(52) U.S. Cl. ..... 473/278; 273/DIG. 13
(58) Field of Search ..... 473/278, 279; 428/17; 273/DIG. 13, DIG. 8

(56) References Cited

U.S. PATENT DOCUMENTS

| | | | | | |
|---|---|---|---|---|---|
| 3,348,847 | A | | 10/1967 | Fischl | |
| 3,414,266 | A | * | 12/1968 | Mitchell | 473/278 |
| 3,423,096 | A | * | 1/1969 | Tone | 473/278 |
| 3,578,333 | A | * | 5/1971 | Elesh | 473/171 |
| 3,639,923 | A | * | 2/1972 | Stewart | 473/269 |
| 3,693,979 | A | * | 9/1972 | Koett | 473/279 |
| 3,735,988 | A | | 5/1973 | Palmer | |
| 3,869,128 | A | * | 3/1975 | Ohashi | 473/278 |
| 3,936,055 | A | | 2/1976 | Scott | |
| 4,279,420 | A | | 7/1981 | Bay | |
| 4,331,332 | A | | 5/1982 | Hughes | |
| 4,387,896 | A | * | 6/1983 | O'Brien | 473/218 |
| 4,535,989 | A | * | 8/1985 | Lovin | 473/158 |
| 4,779,796 | A | | 10/1988 | Lai | |
| 5,028,052 | A | * | 7/1991 | Miller | 473/278 |
| 5,046,741 | A | * | 9/1991 | Ahn | 473/279 |
| 5,082,280 | A | * | 1/1992 | Wang | 473/181 |
| 5,156,398 | A | * | 10/1992 | Kibamoto | 473/278 |
| 5,308,075 | A | * | 5/1994 | Theriault | 473/279 |
| 5,340,109 | A | * | 8/1994 | Miller | 473/262 |
| 5,443,870 | A | | 8/1995 | Lurie | |
| 5,593,355 | A | * | 1/1997 | Beaver | 473/278 |
| 5,630,719 | A | * | 5/1997 | Franklin | 434/252 |
| 5,720,670 | A | | 2/1998 | Oxley | |
| 5,830,080 | A | * | 11/1998 | Reynolds | 473/278 |
| 6,033,317 | A | | 3/2000 | Beam | |
| D429,304 | S | | 8/2000 | Browne, Jr. | |
| 6,106,409 | A | * | 8/2000 | Jackson, Jr. | 473/278 |
| 6,155,931 | A | * | 12/2000 | Perrine | 473/278 |
| 6,312,345 | B1 | * | 11/2001 | Pelz | 473/278 |
| 6,450,895 | B1 | * | 9/2002 | Galluzzo, Jr. | 473/279 |

* cited by examiner

*Primary Examiner*—Paul T. Sewell
*Assistant Examiner*—Nini F. Legesse
(74) *Attorney, Agent, or Firm*—Law Office of Leo Zucker

(57) ABSTRACT

Golf practice apparatus includes a wedge-shaped base, a support layer adhered on an inclined upper surface of the base, and a turf layer adhered atop the support layer. The turf layer extends a certain distance beyond the base to cover a ground surface adjacent to that on which the base is placed to rest. A golf ball may be placed on either an inclined or a flat portion of the turf layer and a golfer can stand on the turf layer in such relation to the golf ball as to simulate a desired uphill, downhill, or sidehill lie, or a flat lie. In the disclosed embodiment, one or more divots may be simulated on either flat or inclined portions on the turf layer.

10 Claims, 4 Drawing Sheets

GOLF PRACTICE PLATFORM

BACKGROUND OF THE INVENTION

1. Field of the Invention

The present invention relates generally to golf practice apparatus.

2. Discussion of the Known Art

Typical golf driving ranges include a number of stalls, each of which is provided with a flat, artificial turf mat with a rubber tee. Shots off of the tee are usually taken with longer clubs or drivers. Players wishing to practice iron shots typically place a golf ball directly on the artificial turf, in order to simulate fairway grass conditions. The flat artificial turf mats used at most driving ranges do not, however, allow a player to simulate uphill, downhill, or sidehill lies, or to take practice shots out of divots such as may be encountered during play on a golf course.

U.S. Pat. No. 5,720,670 (Feb. 24, 1998) discloses a golf practice platform in which a practice surface can be tilted to simulate uphill, downhill, and sidehill shots by the use of screw drives and a pair of double-acting hydraulic cylinders. A practice mat on the platform has perforations through which bristles may pass to rise above the mat so as to simulate grass conditions.

U.S. Pat. No. 5,443,870 (Aug. 22, 1995) relates to a golf mat having an artificial grass area with a flat portion, and a hill portion that is surrounded by the flat portion and enables golfers to simulate uphill, downhill and sidehill lies, according to the patent.

U.S. Pat. No. 3,936,055 (Feb. 3, 1976) describes a portable golf practice device including a frame with side panels that define green and fairway playing surfaces. According to the patent, the panels can be set at a desired inclination to simulate different lies. See also U.S. Pat. No. 4,279,420 (Jul. 21, 1981) which discloses a portable golf practice platform having turf areas, wherein the platform may be set to an angular configuration by a pair of retractable legs; and U.S. Pat. No. 3,735,988 (May 29, 1973) disclosing a practice putting surface comprised of a number of individual rectangular putting sections.

A golf practice platform that can be set up easily within a driving range stall, and which allows a player to practice shots as desired on flat or inclined lies, would be readily desired by all golfers whether beginner or advanced.

SUMMARY OF THE INVENTION

According to the invention, a golf practice platform includes a generally wedge-shaped base having a bottom surface, and an inclined upper surface extending with a determined slope above the bottom surface of the base. A support layer is adhered to the upper surface of the base. A turf layer is adhered to the support layer, and part of the turf layer extends a certain distance beyond the base to cover a ground surface adjacent to that on which the base rests. Accordingly, a golf ball can be placed on the turf layer at a position selected to correspond to an uphill, downhill or sidehill lie, or a flat lie, as desired.

For a better understanding of the invention, reference is made to the following description taken in conjunction with the accompanying drawing and the appended claims.

DETAILED DESCRIPTION OF THE INVENTION

Figure 1:
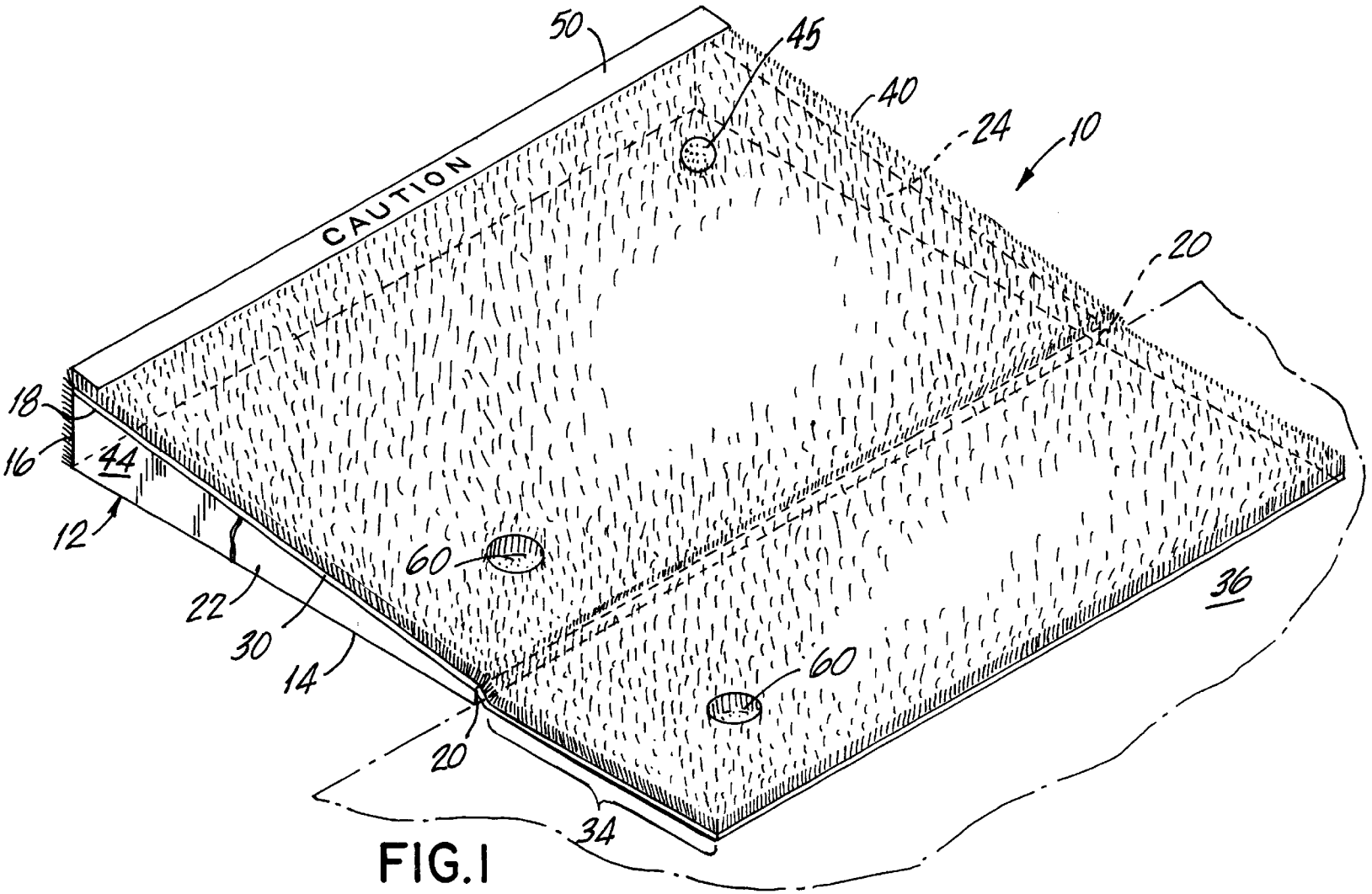
FIG. 1 is a perspective view of a golf practice platform according to the invention.

FIG. 1 is a perspective view of a golf practice platform 10, according to the invention. The platform 10 includes a generally wedge-shaped, relatively light rigid base 12 which may be made of a plastics or a foam material. The base 12 has sufficient strength to support the weight of a golfer while taking practice shots. One example of a suitable material for the base 12 is expanded polystyrene foam with a density of two pounds per cubic foot.

The base 12 has a flat bottom surface 14, an end wall 16, and an inclined upper surface 18. The upper surface extends downward with a determined slope from the end wall 16 to a leading vertical step 20 on the base, opposite the end wall 16. Typical dimensions for the base 12 are, e.g., 5½ inches height at the end wall 16, and one-half inch height at the step 20. As viewed in FIG. 2, the horizontal length of the bottom surface 14 of the base may be, e.g., 34 inches, and the distance between opposite sidewalls 22, 24 of the base 14 may be, e.g., 54 inches.

Figure 2:
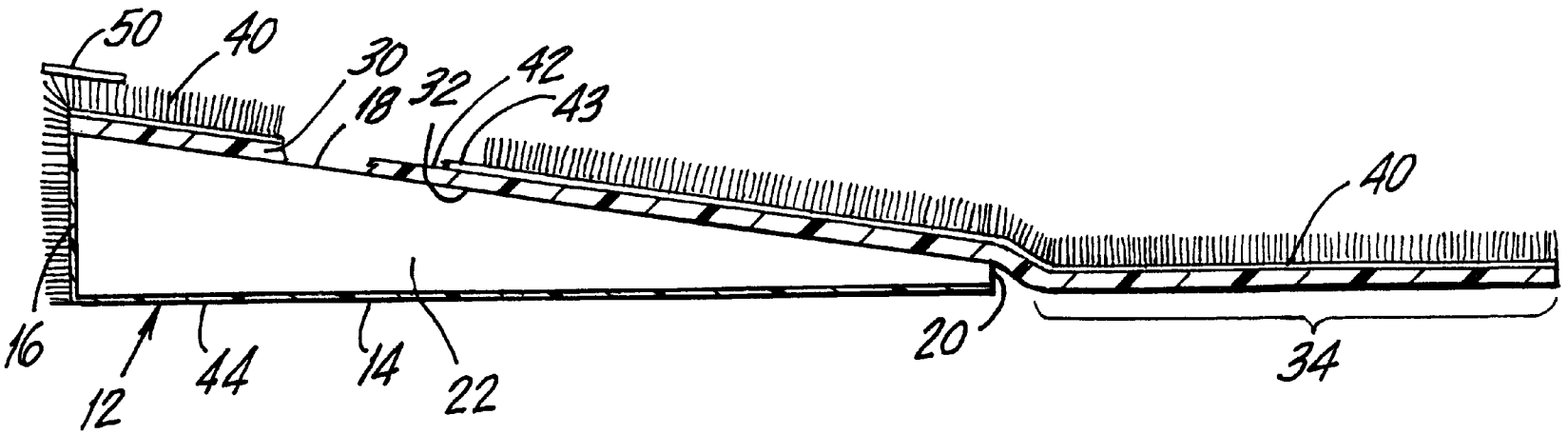
FIG. 2 is a side view of the platform in FIG. 1, with portions broken away to show certain details.

As seen in FIG. 2, an elastic support layer or padding 30 has a first major surface 32 adhered to the upper surface 18 of the base 12. A part 34 of the support layer 30 may extend a certain distance ahead of the leading step 20 on the base 12, so that the extended part 34 of the layer 30 lies substantially flat and covers a ground surface 36 adjacent to that on which the base 12 is positioned to rest.

The support layer 30 has a generally uniform thickness of, for example, one-half inch, and measures, e.g., 54 inches by 54 inches square. The layer 30 can be made of, e.g., closed cell polyethylene. A suitable adhesive for bonding the layer 30 on the upper surface 18 of the base 12 is, e.g., a weather-proof polyurethane adhesive available from Synthetic Surfaces Inc., as "Nordot" Adhesive No. 34N-2.

A turf layer 40 is adhered to a second major surface 42 of the support layer 30 opposite the first major surface 32, including that part of the support layer 30 which extends beyond the leading step 20 on the base 12. The turf layer 40 comprises, for example, ¾ inch nylon tufted bristles (unbaked) with a double woven polypropylene binding 43. The turf layer 40 has a face weight of, e.g., 45 ounces per square yard, and may be adhered to the support layer 30 using the above-mentioned polyurethane adhesive. A portion of the turf layer 40 may also extend to adhere to and cover the base end wall 16 directly, thus protecting the end wall and prolonging the life of the base 12 when the platform 10 is used outdoors.

The two side walls 22, 24 of the base 12, and the bottom surface of the base, are preferably protectively covered with a covering 44 of, e.g., "Cordura" woven nylon having a strength of 1000 denier and available from DuPont. The-covering 44 may be bonded to the side walls and the bottom surface of the base 12 with the above-mentioned polyurethane adhesive. The outside surface of the covering 44 is preferably sealed with a urethane sealant. The covering 44 protects the bottom surface of the base 12 whenever the platform 10 is turned or otherwise moved while in contact with a ground surface.

Figure 4:
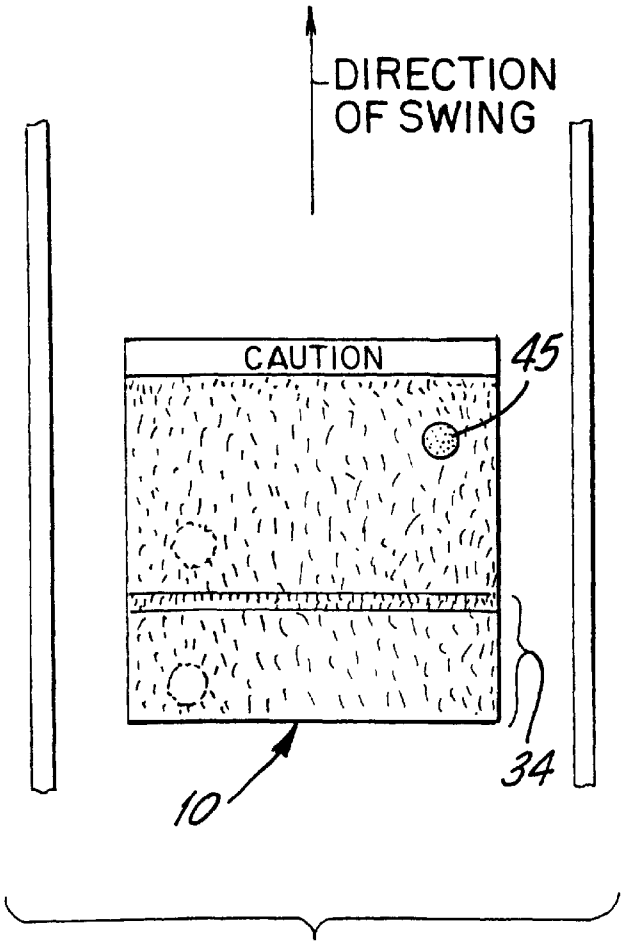
FIG. 4 is a plan view of the platform when set at a second orientation in the stall in FIG. 3.
Figure 3:
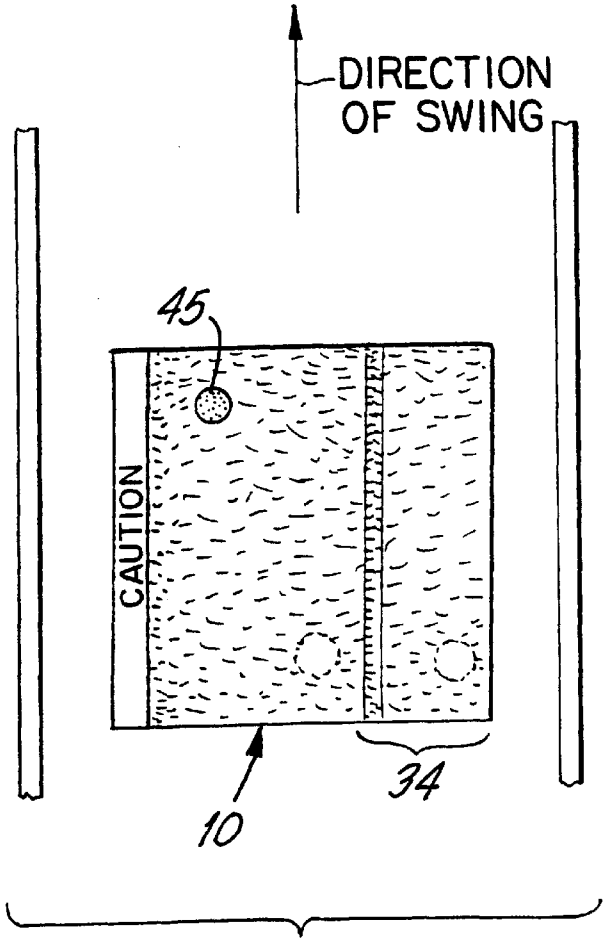
FIG. 3 is a plan view of the platform when set at a first orientation in a stall of a driving range.

In the disclosed embodiment of the practice platform 10, a golf ball 45 can be placed on the turf layer 40 at a position selected to correspond to a desired uphill, downhill or sidehill lie, depending on the orientation of the platform 10 within a stall of a golf driving range. See FIGS. 3 and 4. The golf ball may also be placed on a portion of the turf layer 40 directly above the ground surface 36, to obtain a flat lie.

To ensure safety during use, a 2 to 3 inch wide "warning" stripe 50 is preferably brightly painted or otherwise applied along the turf layer 40 adjacent the vertical end wall 16. Thus, a golfer who may be stepping backward and upward on the inclined portion of the turf layer 40 will be alerted to his or her proximity to the end wall 16.

Figure 5:
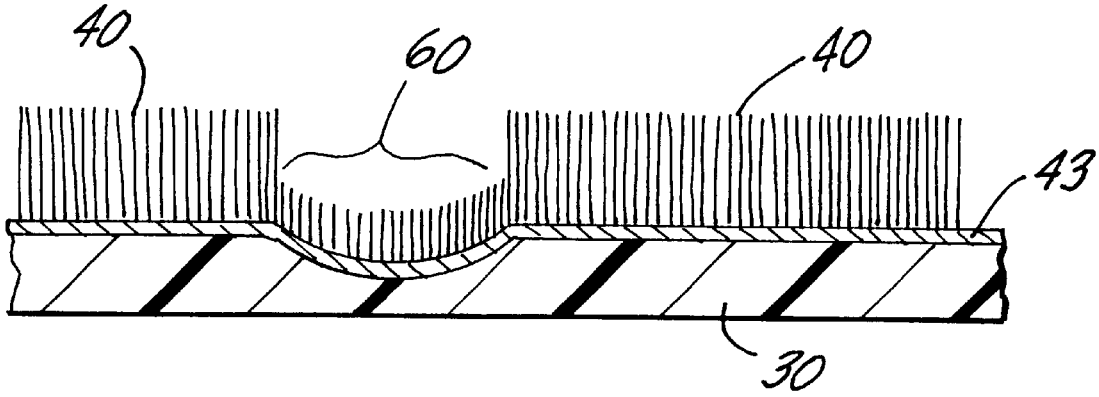
FIG. 5 is an enlarged, cross-sectional view of a divot formed in a turf layer of the platform, according to the invention.

Another desirable feature of the practice platform 10 is that it also allows a golfer to practice shots out of one-or more divots 60. The divots 60 may be located on an inclined portion of the turf layer 40, or a portion of the turf layer 40 that lies flat on the ground surface 36. As shown in FIG. 5, each divot 60 is formed by trimming the bristles of the turf layer 40 to a height of, e.g., ¼ inch, and removing at least some of the material of the support layer 30 beneath the trimmed turf layer. If the divot 60 lies on the inclined upper surface 18 of the base 12, then some of the material of the base may also be removed or depressed so as to allow the depth of the divot 60 to be increased.

While the foregoing description represents a preferred embodiment of the invention, it will be obvious to those skilled in the art that various changes and modifications may be made, without departing from the spirit and scope of the invention which is pointed out by the following claims.

We claim:

1. A golf practice platform, comprising:

a generally wedge-shaped base having a bottom surface, a pair of opposed side walls, an end wall, a leading step, and an inclined upper surface that slopes downward from the end wall to the leading step with a determined slope above the bottom surface, wherein the base is formed of expanded polystyrene foam having a density of about two pounds per cubic foot;

a protective covering of woven nylon adhered on the side walls and on the bottom surface of the base;

an elastic support layer having a first major surface adhered on the upper surface of the base, and the support layer has a second major surface opposite the first major surface; and a turf layer adhered on the second major surface of the support layer, wherein the turf layer comprises unbaked tufted nylon bristles of about ¾ inch height and having a face weight of about 45 ounces per square yard, an inclined portion of the turf layer is adhered on the inclined upper surface of the base, and a flat portion of the turf layer extends together with the support layer a certain distance beyond the base to cover a ground surface adjacent to that on which the base rests;

wherein a golf ball can be placed on either the inclined portion or the flat portion of the turf layer, and a golfer can stand on either portion and in such relation to the golf ball, so as to simulate an uphill, a downhill, a sidehill, or a flat lie.

2. A golf practice platform according to claim 1, wherein the bristles of the turf layer are trimmed at one or more locations to a height of about ¼ inch and at least some of the support layer is removed beneath the turf layer at the locations where the bristles are trimmed, thus simulating corresponding divots in the turf layer.

3. Golf practice apparatus according to claim 2, wherein the inclined upper surface of the base has depressions at locations corresponding to divots that are simulated in the turf layer.

4. A golf practice platform according to claim 1, wherein the woven nylon protective covering has a strength of about 1000 denier.

5. A golf practice platform according to claim 1, wherein the height of said end wall is about 5½ inches.

6. A golf practice platform according to claim 1, wherein the height of said leading step is about ½ inch.

7. A golf practice platform according to claim 1, wherein the support layer has a generally uniform thickness of about one-half inch.

8. A golf practice platform according to claim 1, wherein the bottom surface of the base has a rectangular perimeter of about 54 inches by 34 inches.

9. A golf practice platform according to claim 1, wherein the support layer comprises closed cell polyethylene.

10. A golf practice platform according to claim 1, wherein the turf layer has a warning stripe on the inclined portion of the turf layer.

* * * * *